United States Patent [19]

Seifert et al.

[11] Patent Number: 4,486,063

[45] Date of Patent: Dec. 4, 1984

[54] CORE CRIMP IGNITION TERMINAL

[75] Inventors: Raymond C. Seifert, Warren; Frank J. Miller, Jr., Bristolville, both of Ohio

[73] Assignee: General Motors Corporation, Detroit, Mich.

[21] Appl. No.: 394,629

[22] Filed: Jul. 2, 1982

[51] Int. Cl.[3] ..... H01R 4/24

[52] U.S. Cl. ..... 339/97 C; 339/223 S

[58] Field of Search ..... 339/97 C, 223 R, 223 S

[56] References Cited

U.S. PATENT DOCUMENTS

| | | | |
|---|---|---|---|
| 2,024,814 | 12/1935 | Bell | 173/269 |
| 2,718,627 | 9/1955 | Swenson | 339/276 |
| 3,320,574 | 5/1967 | Tuchel | 339/217 |
| 4,209,221 | 6/1980 | Chupak et al. | 339/223 S |

*Primary Examiner*—Joseph H. McGlynn
*Assistant Examiner*—Paula Austin
*Attorney, Agent, or Firm*—William A. Schuetz

[57] ABSTRACT

A two-piece electrical connector means for detachably connecting an ignition cable or the like having a plurality of high tensile strength, nonconductive strands coated with an electrically conductive material to a mating stud terminal is disclosed. The connector means includes a first terminal member of crimpable material having a longitudinally extending support portion and a pair of wings or arms extending transversely of the support portion and a second terminal member having a socket portion which is adapted to snap fittingly engage a stud terminal and a longitudinally extending tongue portion which is clamped to the support portion of the first terminal member by bending the pair of transversely extending wings or arms of the support portion over and into engagement with the tongue portion of the second terminal on the side opposite its side of engagement with support portion, and wherein the support portion of the first terminal member has crimping means for electrically and mechanically connecting the first terminal member to the exposed end of the cable at spaced locations.

3 Claims, 12 Drawing Figures

CORE CRIMP IGNITION TERMINAL

The present invention relates to electrical connectors or terminals, and more particularly to a two-piece electrical connector for connecting an ignition cable to a spark plug terminal.

Heretofore, two-piece electrical connectors or terminals have been provided for connecting an ignition cable to a spark plug terminal. For example, to Bell U.S. Pat. No. 2,024,814 and Chupak et al, U.S. Pat. No. 4,209,211 (assigned to the same assignee as the present invention) shows such construction. It is also known to provide a two-piece electrical connector in which one terminal thereof is crimped to both an exposed end portion of an insulated conductor and to the adjacent insulated portion thereof. Such a connector is shown in the patent to Tuchel, U.S. Pat. No. 3,320,574.

In the above noted patent to Chupak et al, U.S. Pat. No. 4,209,211, a single crimp is used to both electrically connect and mechanically connect the terminal to the ignition cable. In this construction, the ignition cable at its end is stripped of its insulation and its exposed core is then folded back over the adjacent end of the insulation. By crimping in this fashion both an electrical connection and a mechanical connection is made in one crimp. While this type of connection has been widely and successfully used, it is, nevertheless, dependent upon the mechanical properties of the insulating material to maintain adequate pressure in the crimp area and thus, the quality of the termination is sensitive to variations in insulating materials, formulations and states of cure thereof.

It has also been proposed to merely crimp an electrical terminal directly to an exposed end of an insulated conductor. Such a terminal is shown in patent to Swenson, U.S. Pat. No. 2,718,627. While this type of terminal can be used with a metal conductor, it is not suitable for use with ignition cable of the type having a plurality of high tensile strength, nonconductive strands coated with an electrically conductive material. It has been found that a single crimp directly to the core which is sufficiently severe to prevent pull-off of the connector will not provide proper electrical conductivity. Conversely a crimp directly to such a core, which provides good electrical conductivity is insufficient to provide sufficient pull-off force.

Accordingly, it is an object of the present invention to provide a novel two-piece electrical connector or terminal for connecting an ignition cable having a plurality of high tensile strength, nonconductive strands coated with an electrically conductive material to a mating stud terminal, and in which one of the terminals is crimped to an exposed end of the ignition cable at spaced locations to provide good electrical conductivity with one crimp and to provide a good mechanical connection with the other crimp which is resistant to pull-off forces.

Another object of the present invention, is to provide a novel two-piece electrical connector means for detachably connecting an ignition cable or the like having a plurality of high tensile strength, nonconductive strands coated with an electrically conductive material to a mating stud terminal, and wherein the connector means includes a first terminal member of crimpable material having a longitudinally extending support portion and a pair of arms extending transversely of the support portion and a second terminal member having a socket portion which is adapted to snap fittingly engage the stud terminal and a longitudinally extending tongue portion which is clamped to the support portion of the first terminal member by bending the pair of transversely extending arms of the support portion over and into engagement with the tongue portion of the second terminal member on the side opposite its side of engagement with the support portion, and in which the support portion of the first terminal member has spaced crimping means for both electrically and mechanically connecting the first terminal member to an exposed end of the cable whereby both good electrical conductivity and good mechanical resistance of pull-off forces are achieved.

A further object of the present invention is to provide a novel two-piece electrical connector means, as defined in the preceding objects, and in which the first terminal member also includes a crimping means for crimping the same to an insulated portion of the cable so as to provide additional strain relief and support for the first terminal member.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
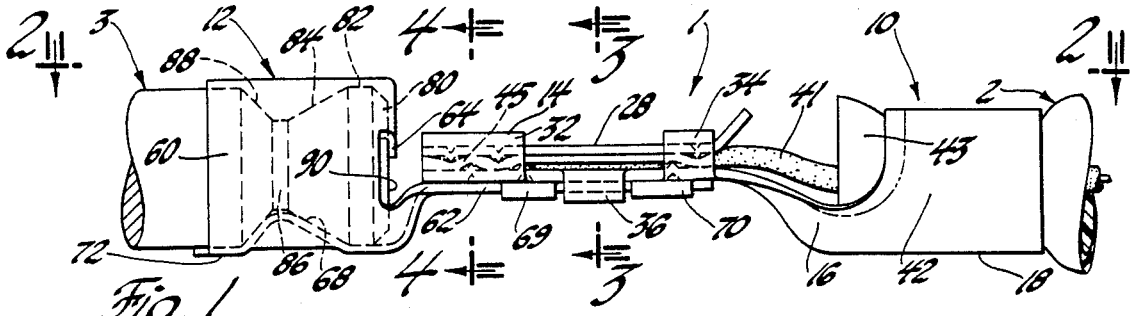
FIG. 1 is a side elevational view of the preferred embodiment of the novel two-piece electrical connector means of the present invention and showing the parts connected.

The present invention provides a novel two-piece electrical connector or connector means 1 for detachably connecting an ignition cable or the like 2 having a plurality of high tensile strength, nonconductive strands coated with an electrically conductive material to a mating stud terminal, such as a spark plug terminal 3.

The two-piece electrical connector means 1 comprises a first connector or terminal 10 which is attached to the ignition cable 2 and a second connector or terminal 12 which is attached to the first terminal 10 and also detachably connected with the spark plug terminal 3.

Figure 5:
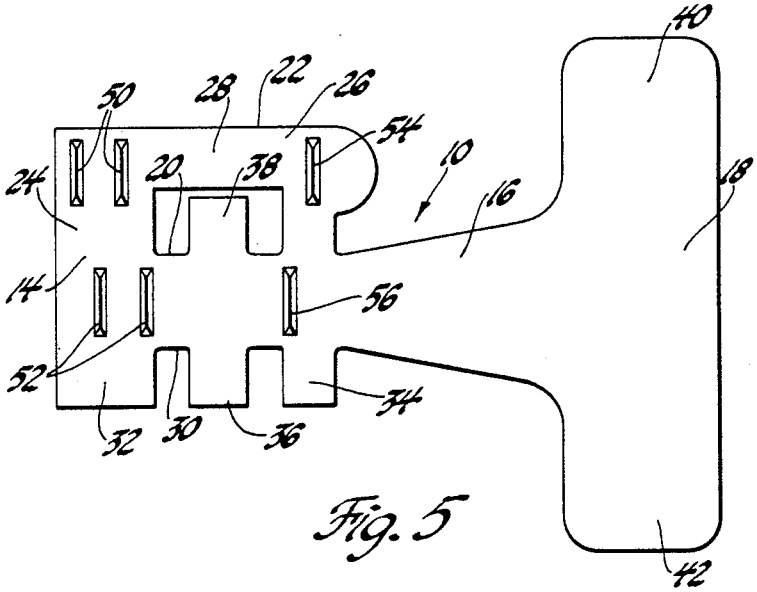
FIG. 5 is a top plan view of one of the electrical connectors and showing the same as it appears after being stamped from flat sheet stock.

The first terminal or terminal member 10 is stamped from flat, thin gauged, cadmium plated steel material to the configuration shown in FIG. 5. The terminal 10 has a forward support portion 14, a midportion 16 and a rearward portion 18. Integral with the forward support portion 14 at its upper side or edge 20, as viewed in FIG. 5, is an inverted U-shaped crimping wing 22. The crimping wing 22 has a forward crimp section 24, a rearward crimp section 26 and an intermediate bridging section 28. Integral with the forward support portion 14 along its lower side or edge 30, as viewed in FIG. 5, is a forward wing 32 and a rearward wing 34. Integral with the forward support portion 14 along its lower and upper sides 30 and 20 and intermediate its forward and rearward ends thereof are crimping wings or arms 36 and 38, respectively.

The rearward portion 18 of the terminal member 10 includes a pair of large crimping wings 40 and 42 and the intermediate portion 16 serves as a bridge between the crimping wings 40 and 42 and the forward support portion 14.

Figure 6:
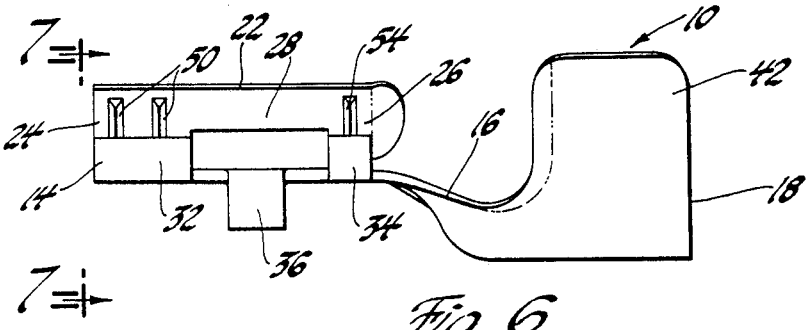
FIG. 6 is a side elevational view of the electrical connector shown in FIG. 5, but showing the same after being partially formed to a position for receipt of the cable.
Figure 7:
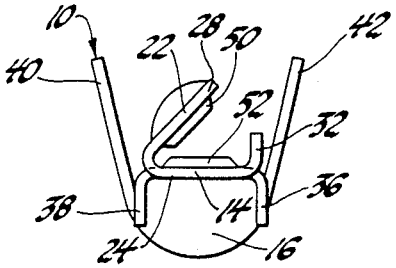
FIG. 7 is an end elevational view looking in the direction of the arrows 7—7 of FIG. 6.
Figure 8:
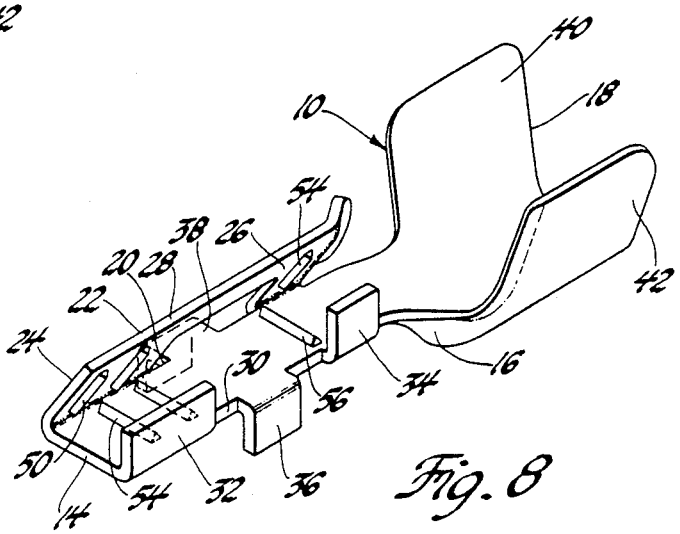
FIG. 8 is a perspective view of the electrical connector shown in FIG. 6.

The terminal member 10 is adapted to be bent from the configuration, as shown in FIG. 5, to a partially formed configuration as shown in FIGS. 6 through 8 prior to being connected to the cable 2. The crimping wing 22 is bent along the side edge 20 of the forward portion 14 so to be disposed in a plane that forms an approximate 45° included angle with the plane of the forward support portion 14. The wings 32 and 34 are bent upwardly so as to be normal to the plane of the forward support portion 14. The wings or arms 36 and 38 are bent downwardly so as to extend normal to the plane of the forward support portion 14. The intermediate portion 16 is bent to the configuration shown in FIGS. 6 and 8 and the rearward portion 18 is bent upwardly so that the wings 40 and 42 thereof form a cradle for receipt of the cable 2.

When the terminal member 10 is bent to the configuration shown in FIGS. 6 through 8, it is in a position to receive and be attached to the ignition cable 2. The ignition cable 2 is preferably of the type manufactured by the assignee of the present invention and sold under the tradename Delcor®. It comprises a core 41 having a plurality of high tensile strength fiber strands impregnated with a graphite solution. The core 41 has high tensile strength and good electrical conductivity. These graphite impregnated strands are purchased under the tradename Kevlar®, a product manufactured by the E. I. DuPont Corporation of Wilmington, Del. The impregnated strands are then coated with a suitable coating (not shown), covered with a fabric (not shown) and rubber-like insulation 43. The latter coating enables the fabric and rubber insulation 43 to be stripped from an end of the ignition cable 2 without disturbing the core 41 thereof.

Figure 2:
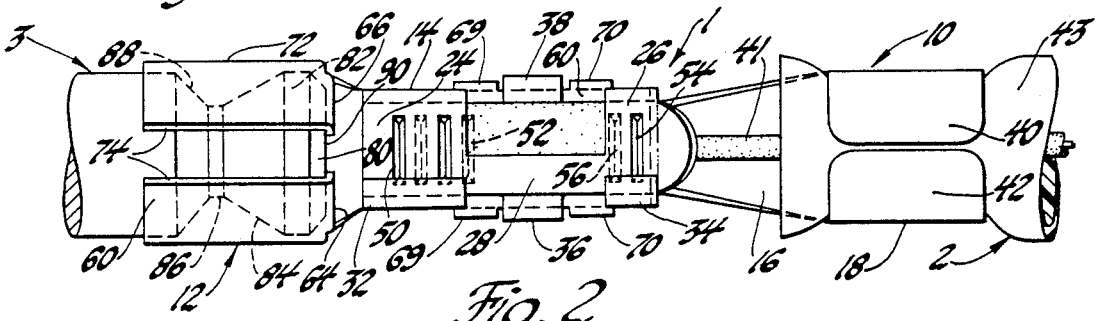
FIG. 2 is a top elevational view looking in the direction of the arrows 2—2 of FIG. 1.
Figure 3:
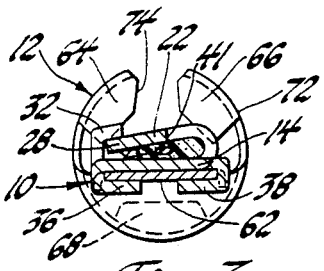
FIG. 3 is a cross-sectional view taken approximately along lines 3—3 of FIG. 1.
Figure 4:
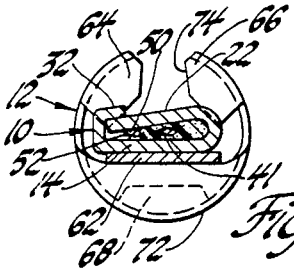
FIG. 4 is a cross-sectional view taken approximately along lines 4—4 of FIG. 1.

As best shown in FIGS. 1 through 4, the ignition cable 2 is stripped at one end of the fabric and rubber insulation 43 so as to leave an exposed length of core 41. To connect the terminal member 10 to the ignition cable 2, the exposed end of the core 41 is laid on the forward support portion 14 of the terminal 10 and the adjacent insulated portion is laid within the cradle defined by the crimping wings 40 and 42. When the ignition cable 2 is so positioned, the crimping wing 22 is further folded or crimped toward the forward support portion 14 and with the forward and rearward sections 24 and 26 as well as the bridging section 28 of the crimping wing 22 engaging the exposed core 41 of the ignition cable 2. The crimp wings 32 and 34 adjacent their upper ends are thereafter folded or crimped toward the forward support portion 14 and over the backside of the crimping wing 22, as best shown in FIGS. 2 through 4.

It should be noted at this point that the forward section 24 of the crimp wing 22 has a pair of longitudinally spaced indented ribs 50 extending transversely of its plane and that the forward support portion 14 adjacent its forward end likewise has a pair of longitudinally spaced indented ribs 52 extending transversely of its plane. The ribs 50 and 52 are longitudinally offset from one another so that when the crimp wing 22 is folded onto the forward support portion 14 the core of the ignition cable 2 will be bent or undulated through the longitudinal extent of the crimp, as indicated by the dotted line 45 in FIG. 1. Likewise, the rearward section 26 of the crimp wing 22 and the forward support portion 14 adjacent its rearward end contain single indented ribs 54 and 56, respectively, which extend transversely from their planes. The ribs 54 and 56 are also longitudinally offset so as to cause the core of the ignition cable to be undulated when the crimp wing 22 is clamped against support portion 14. The ribs 50, 52, 54 and 56 are formed when the terminal 10 is stamped to the configuration shown in FIG. 5 by indenting the metal with suitable punches and dies.

The crimp affected by the crimping section 26 of the crimping wing 22 and the crimping wing 34 is such as to exert only a light clamping pressure against the core 41 of the ignition cable 2. This insures good electrical conductivity between the terminal and the core 41 of the ignition cable 2. In contrast, the crimp affected by the crimping portion 24 of the crimp wing 22 and the crimp wing 32 is such as to exert a tight clamping pressure to the core 41 of the ignition cable 2. This latter crimp provides a good mechanical connection with the core of the ignition cable 2 and provides the primary resistance to terminal pull-off from the cable 2. What is achieved is a terminal means 10 for directly clamping onto a core 41 of an ignition cable 2 which provides for both a good mechanical connection and which provides for good electrical conductivity. In addition, the provision of the integral bridging section 28 of the crimp wing 22 adds to the structural rigidity of the terminal 10 upon being crimped to the core 41 of the cable 2.

The terminal member 10 has its forward support portion 14 positioned along the axis of the ignition cable 2 by the configuration of the intermediate portion 16 and the cable 2 is additionally held in place by the rearward portion 18 of the terminal member 10. To this end the crimp wings 40 and 42 are crimped onto the adjacent insulation portion 43 of the ignition cable 2. This supports the terminal member 10 in its position at the end of the ignition cable 2 and also provides for additional strain relief or resistance to any pull-off forces.

Figure 9:
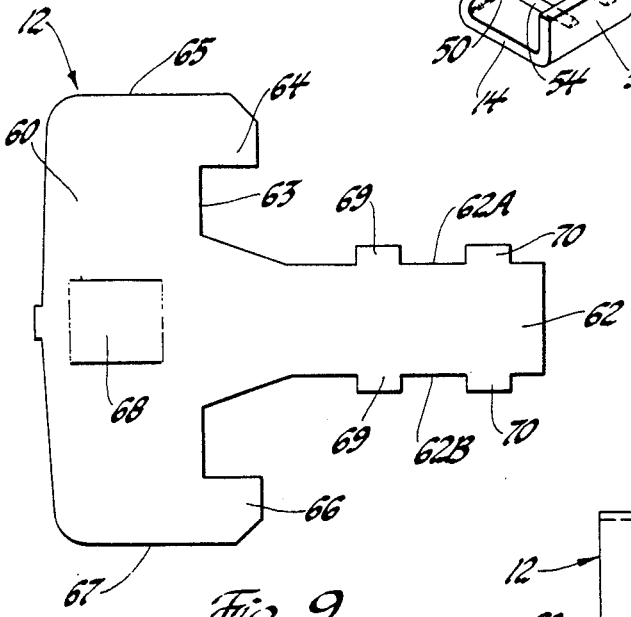
FIG. 9 is a top plan view of the other electrical connector and showing the same after it is stamped from flat sheet material.

The terminal or terminal member 12 is stamped from thin gauged, flat, zinc coated, tempered steel stock to the configuration shown in FIG. 9. As stamped, the terminal member 12 has a rearward portion 60 and a forwardly extending tongue portion 62. The rearward portion 60 at its forward side edge 63 includes a pair of forwardly extending tabs 64 and 66 and intermediate its upper and lower side edges 65 and 67, as viewed in FIG.

9, in an upraised detent 68. The forward tongue portion 62 includes pairs of spaced transversely extending crimping wings 69 and 70 extending transversely of its upper and lower side edges 62A and 62B.

Figure 10:
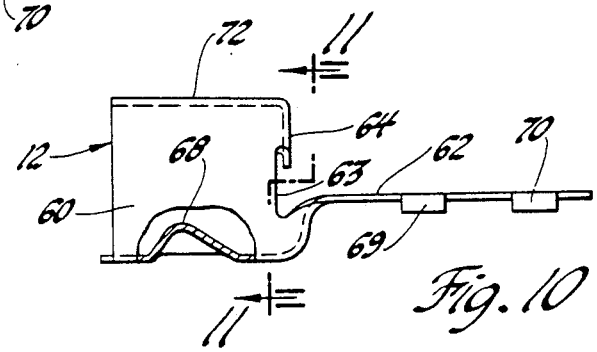
FIG. 10 is a side elevational view of the terminal shown in FIG. 9, but showing the same fully formed.
Figure 11:
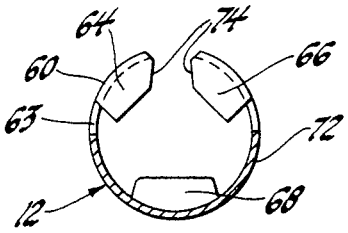
FIG. 11 is a sectional view taken approximately along the lines 11—11 of FIG. 10.
Figure 12:
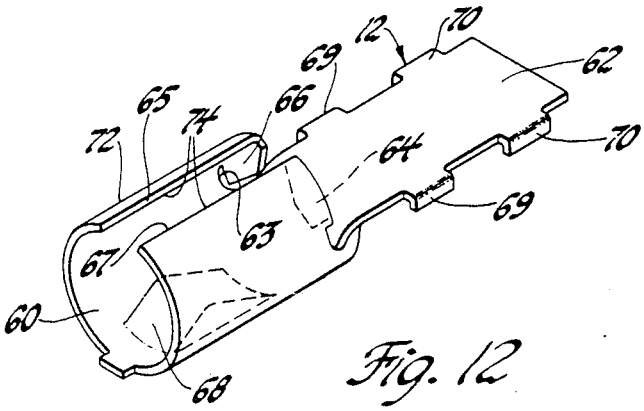
FIG. 12 is a perspective view of the fully formed connector shown in FIG. 10.

After being stamped, the terminal 12 is then formed or rolled from the position shown in FIG. 9 to form a circular split sleeve 72, as shown in FIGS. 10 through 12. The circular split sleeve 72 extends about 330° and defines a longitudinally extending gap 74 of about 30°. The sleeve 72 has its inwardly projecting detent 68 diametrically opposite the gap 74. The tabs 64 and 66 are bent at 90° to provide a pair of spaced end stops adjacent the gap 74. The tabs 64 and 66 extend approximately normal to the axis of the sleeve 72. The wings 69 and 70 are bent downwardly, as best shown in FIGS. 10 and 12, and for reason to be noted hereinafter.

The terminals 10 and 12 are adapted to be connected together by placing the support portion 14 on top of the tongue 62 of the terminal member 12. The wings or arms 36 and 38 of the terminal member 10 are then bent 90° across the underside of the tongue portion 62. This clamps the terminal member 10 to the terminal member 12. Relative longitudinal movement is prevented by the wings 69 and 70 of the terminal member 12.

The connected terminals 10 and 12 can then be repeatedly attached to and detached from the spark plug terminal 3 by means of the socket or sleeve 72. The sleeve 72 is made from tempered spring steel. The spark plug terminal 3 is standard configuration, comprising a diverging conical end portion 80, a cylindrical band portion 82, a converging conical portion 84, a cylindrical neck 86 and a tapered shoulder 88. When the terminal 12 is attached to the spark plug terminal 3, the split sleeve 72 is cammed open as the detent 68 engages the end portion 80 of the terminal 3. When the detent 68 clears portion 82 on the terminal 3, the sleeve 72 snap closes and engages the conical portions 84 and 88 to resist detachment. Over insertion is prevented by the stop tabs 64 and 66 engaging flat end surface 90 on the terminal 3. In the assembled position, the split sleeve 72 is still stressed and has a tight resilient fit against the cylindrical band portion 82 due to its spring-like qualities or self-biasing forces toward its unstressed position. Since the split sleeve 72 is spaced from the portions mechanically connecting the two members 10 and 12, the independent spring action of the split sleeve 72 is not substantially affected by any welding which might occur between the members during operation in high temperature environments.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A two-piece electrical connector means for detachably connecting an ignition cable or the like having a plurality of high tensile strength, nonconductive strands coated with an electrically conductive material to a mating stud terminal, said connector means including a first terminal member of crimpable material having a longitudinally extending support portion and a pair of arms extending transversely of said support portion and a second terminal member having a socket portion which is adapted to snap fittingly engage the stud terminal and a longitudinally extending tongue portion which is clamped to said support portion of said first terminal member by bending said pair of transversely extending arms of the support portion over and into engagement with said tongue portion of said second terminal member on its side opposite its side of engagement with the support portion, the improvement comprising:

said support portion of said first terminal member having crimping means for directly electrically and mechanically connecting the first terminal member to an exposed end of the coated nonconductive strands of said cable, said crimping means comprising a first crimp wing integral with one side of said longitudinally extending support portion and being foldable to lightly clamp the exposed strands of said cable against the support portion to maintain the integrity of the electrically conductive coating on the strands and make an electrical connection therewith, a second crimp ring integral with said support portion and remote from said socket portion of said second terminal and foldable over said first crimp wing to lightly clamp the exposed strands of the cable against the support portion to maintain the integrity of the conductive coating on the strands and make an electrical connection therewith, and a third crimp wing integral with said support portion and spaced from the second crimp wing, said third crimp wing being located adjacent said socket portion of said second terminal and being foldable over said first crimp wing for tightly clamp the cable to make a strong mechanical connection with the coated nonconductive strands thereof.

2. A two-piece electrical connector means for detachably connecting an ignition cable or the like having a plurality of high tensile strength, nonconductive strands coated with an electrically conductive material to a mating stud terminal, said connector means including a first terminal member of crimpable metal material having a longitudinally extending planar support portion and a pair of arms extending transversely of said planar support portion and a second terminal member having a socket portion which is adapted to snap fittingly engage said stud terminal and a longitudinally extending planar tongue portion which is clamped to said support portion of said first terminal member by bending said pair of transversely extending arms of the support portion over and into engagement with said tongue portion of said second terminal member on its side opposite its side of engagement with the support portion, the improvement comprising:

said support portion of said first terminal member having crimping means for directly electrically and mechanically connecting the first terminal member to an exposed end of the coated nonconductive strands of said cable, said crimping means comprising a first generally U-shaped crimping wing integral with one side of said support portion of said first terminal member and which straddles one of said arms, said first crimping wing being foldable over said exposed end of said cable to lightly clamp the cable to said support portion of said first terminal member, a second crimp wing integral with said support portion and remote from said socket portion of said second terminal and foldable over said first crimping wing to lightly clamp the exposed strands of said cable against the support portion to maintain the integrity of the conductive coating on the strands and make an electrical connection therewith, and a third crimp wing integral with said support portion adjacent said socket portion of said second terminal and spaced from the second crimping wing and foldable over said first crimping wing to tightly clamp said exposed cable against said support portion to make a strong mechanical connection with the coated nonconductive strands thereof.

3. A two-piece electrical connector means for detachably connecting an ignition cable or the like having a plurality of high tensile strength, nonconductive strands coated with an electrically conductive material to a mating stud terminal, said connector means including a first terminal member of crimpable metal material having a longitudinally extending planar support portion and a pair of arms extending transversely of said planar support portion and a second terminal member having a socket portion which is adapted to snap fittingly engage said stud terminal and a longitudinally extending planar tongue portion which is clamped to said support portion of said first terminal member by bending said pair of transversely extending arms of the support portion over and into engagement with said tongue portion of said second terminal member on its side opposite its side of engagement with the support portion, the improvement comprising:

said support portion of said first terminal member having crimping means for directly electrically and mechanically connecting the first terminal member to an exposed end of said coated nonconductive strands of said cable, said crimping means comprising a first generally U-shaped crimping wing defining first and second spaced crimping wing sections and an intermediate bridging section, said first and second crimping wing sections being integral with one side of said support portion of said first terminal member and respectively located on opposite sides of one of said arms, said first crimping wing being foldable over said exposed end of said cable so that said first and second crimping wing sections lightly clamp the cable to said support portion of said first terminal member, a second crimp wing integral with said support portion and remote from said socket portion of said second terminal and foldable over said first crimping wing section to lightly clamp the exposed strands of said cable against the support portion to maintain the integrity of the conductive coating on the strands and make an electrical connection therewith, a third crimp wing integral with said support portion adjacent said socket portion of said second terminal and foldable over said second crimping wing section to tightly clamp said exposed cable against said support portion to make a strong mechanical connection with the coated nonconductive strands thereof, and said tongue portion of said second terminal having spaced wings extending transversely from its side opposite its side of engagement with the support portion of said first terminal and located on opposite sides of said arms of said support portion, said arms being engageable with said latter wings upon relative longitudinal movement of said first and second terminals so as to prevent the terminals from being disconnected.

* * * * *